United States Patent [19]

Sweeney et al.

[11] 4,261,702

[45] Apr. 14, 1981

[54] NOVEL PROCESS FOR PREPARATION OF GASOHOL

[75] Inventors: William M. Sweeney, Wappingers Falls; Sheldon Herbstman, Spring Valley, both of N.Y.

[73] Assignee: Texaco Inc., White Plains, N.Y.

[21] Appl. No.: 138,029

[22] Filed: Apr. 7, 1980

[51] Int. Cl.[3] ..... C10L 1/18

[52] U.S. Cl. ..... 44/56; 44/77

[58] Field of Search ..... 44/56, 77

[56] References Cited

U.S. PATENT DOCUMENTS

| | | | |
|---|---|---|---|
| 1,582,420 | 4/1926 | Nikaido | 44/77 |
| 2,842,432 | 7/1958 | Newman et al. | 44/77 |

*Primary Examiner*—Winston A. Douglas
*Assistant Examiner*—J. V. Howard
*Attorney, Agent, or Firm*—Carl G. Ries; Robert A. Kulason; Carl G. Seutter

[57] ABSTRACT

Gasoline and aqueous alcohol, such as 95 w % ethanol, are mixed to form wet two-phase gasahol (including a hydrocarbon phase and a water phase); and the water-phase is separated and reacted with a ketal, acetal, or orthoester to form a dry composition which is blended back into the gasoline-phase to form a dry gasahol.

12 Claims, 1 Drawing Figure

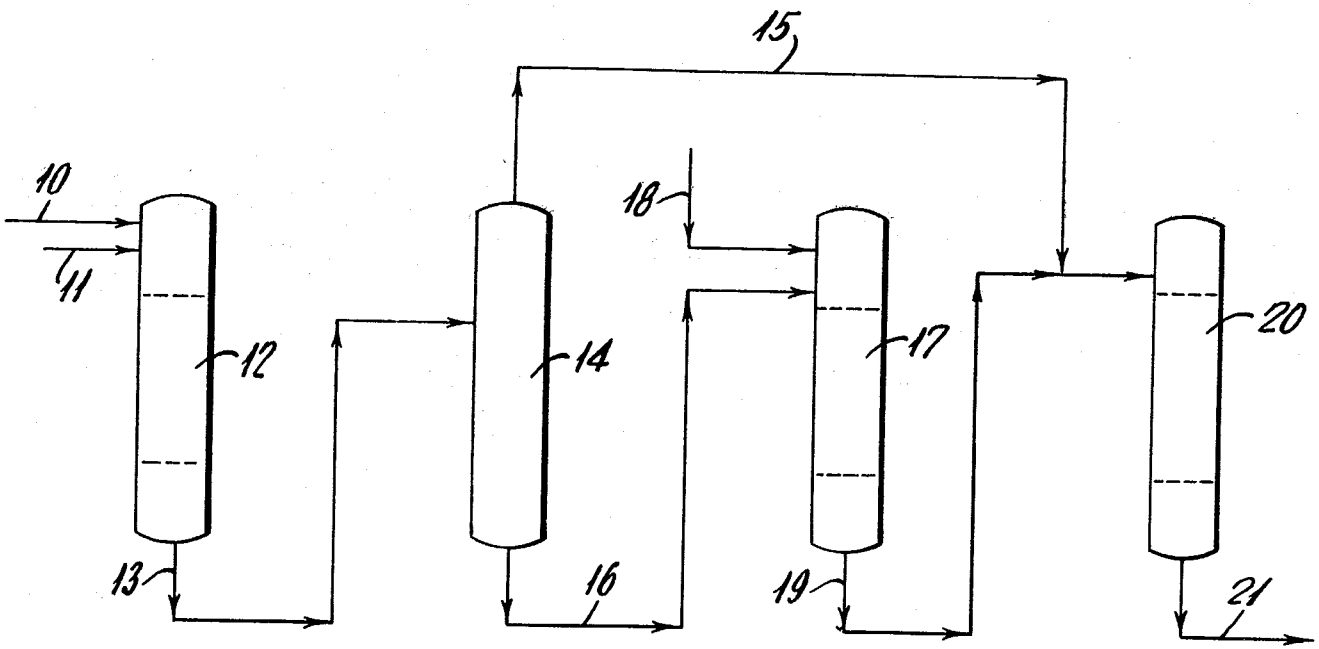
10
11
12
13
14
15
16
17
18
19
20
21

NOVEL PROCESS FOR PREPARATION OF GASOHOL

FIELD OF THE INVENTION

This invention relates to a novel process for forming dry compositions from mixtures of hydrocarbons with wet alcohols. More particularly it relates to the preparation of dried, stable gasahol from gasoline and 95 w % ethanol.

BACKGROUND OF THE INVENTION

As is well known to those skilled in the art, liquid hydrocarbons may be combined with certain water-miscible alcohols. Typical of such products is gasahol, a mixture of gasoline and absolute ethanol. It is found that if such mixtures are formulated from alcohols which contain water in amounts as small as 0.1 v %–5 v %, the resulting composition separates into two phases.

It is an object of this invention to provide a process for preparing a dry single phase hydrocarbon composition. Other objects will be apparent to those skilled in the art.

STATEMENT OF THE INVENTION

In accordance with certain of its aspects, this invention is directed to a process which comprises (i) mixing a liquid hydrocarbon fuel and aqueous alcohol thereby forming a two-phase wet hydrocarbon fuel including (i) an upper hydrocarbon-rich phase and (ii) a lower phase containing alcohol and water;

(ii) separating said lower phase containing alcohol and water from said upper hydrocarbon-rich phase;

(iii) reacting said lower phase containing alcohol and water at pH below 7 with a ketal, an acetal, or an orthoester whereby said ketal, acetal, or orthoester reacts with said water thereby forming a substantially water-free composition;

(iv) blending said water-free composition and said upper hydrocarbon-rich phase thereby forming a single phase dry hydrocarbon product; and (v) recovering said single phase dry hydrocarbon product.

DESCRIPTION OF THE INVENTION

The hydrocarbon fuels which may find use in practice of this invention include (i) hydrocarbon fuels which are heavier than gasoline or (ii) lighter hydrocarbon fuels including gasoline.

The hydrocarbon fuels heavier than gasoline which may be treated by the process of this invention include those which typically have an initial boiling point (ibp) above about 320° F. Typically such fractions may be identified as kerosene, diesel oil or furnace oil, fuel oil, light gas oil, heavy gas oil, light cycle gas oil, heavy cycle gas oil, vacuum gas oil etc. These fractions which include middle distillates commonly have an initial boiling point above about 340° F. and may have end points as high as 1100° F. They typically have an API gravity below about 55.

In the case of a kerosene, the fuel may be characterized by an ibp of 300° F.–400° F., say 350° F., an ep of 500° F.–600° F., say 550° F., and an API gravity of 30–70, say 50.

In the case of a diesel oil or furnace oil, the fuel may be characterized by an ibp of 325° F.–425° F., say 350° F., an ep of 575° F.–690° F., say 610° F., and an API gravity of 25–50, say 40.

In the case of a vacuum gas oil, the fuel may be characterized by an ibp of 600° F.–700° F., say 650° F., an ep of 900° F.–1100° F., say 1050° F., and an API gravity of 10–35, say 25.

In the case of a light cycle gas oil, it may be characterized by an ibp of 300° F., say 350° F., an ep of 575° F.–670° F., and an API gravity of 20–40, say 30.

In the case of a heavy cycle gas oil, it may be characterized by an ibp of 500° F.–550° F., say 525° F., an ep of 600° F.–700° F., say 680° F., and an API gravity of 20–35, say 25.

In the case of a residual fuel oil, it may be characterized by an API gravity of 5–25, say 20.

Illustrative fuels which may be treated by the process of this invention include (i) a No. 2 furnace oil having an ibp of 376° F., an ep of 623° F., an API gravity of 35, and a cetane number of 47.5; (ii) a vacuum gas oil having an ibp of 680° F., and ep of 1050° F., and an API gravity of 25.

Although it is possible to stabilize liquid hydrocarbon fuels of lower molecular weight, the advantages of this invention are particularly apparent when the hydrocarbon fuel is a liquid at ambient conditions, typically 25° C. and atmospheric pressure.

The liquid hydrocarbon fuel with respect to which the advantages of this invention are particularly apparent may typically be a motor fuel such as a gasoline; a naphtha etc. When the fuel is a gasoline, it may for example be a 100 octane blended gasoline having an ep of 320° F. When the fuel is a naphtha it may be characterized by its ibp of 200° F. and its ep of 320° F.

The water-miscible alcohols (which are also miscible with said hydrocarbon fuels) which may be used in practice of the process of this invention include methanol, ethanol, n-propyl alcohol, isopropyl alcohol, hexylene glycol-2,3; etc. Alcohols, such as isobutanol, n-butanol, etc., which are only partially miscible with water and with hydrocarbon may be employed but their use is generally not advantageous.

In the case of a light fuel such as gasoline, the water-miscible alcohols (including methanol and ethanol) are substantially miscible with gasoline when the system is dry; but if water is present, they form two phases. Comparable results are observed for hydrocarbon fuels heavier than gasoline (except that dry methanol is substantially insoluble in dry hydrocarbons heavier than gasoline).

It is a particular feature of the process of this invention that it permits attainment of satisfactory product mixtures from wet alcohols such as 95 w % ethanol.

In practice of the process of this invention, the charge hydrocarbon fuel, preferably dry gasoline, is mixed with the aqueous water-miscible alcohol which is miscible with the hydrocarbon fuel.

The liquid hydrocarbon charge may be mixed with 1 v %–20 v % or more, typically 5 v %–10 v %, say 10 v % of a water-miscible alcohol which is miscible with the hydrocarbon fuel. In one embodiment 90 volumes of gasoline may be mixed with 10 volumes of 95 w % ethanol. In another embodiment 80 volumes of diesel fuel may be mixed with 20 volumes of 95 w % ethanol.

Mixing may be effected by passing the two charge components into a vessel with or without agitation. Preferably it is effected by passing the two charge components through a packed bed of inert materials, this being effected at 25° F.–125° F., say ambient temperature of 75° F.

The uniformly mixed composition is found to be a two-phase mixture including an upper hydrocarbon layer and a lower aqueous layer. It is generally found that the upper hydrocarbon layer contains a major portion of the charge i.e. 90 v %–99 v %, say 95 v % while the lower aqueous layer contains a minor portion of the charge i.e. 1 v %–10 v %, say 5 v %. In the case of gasoline for example, 100 volumes of charge may typically give 95 parts of upper hydrocarbon layer containing 88.5 parts of gasoline, 9.2 parts of alcohol, and 0.3 parts of water and 5 parts of a lower aqueous layer containing 0.7 parts of water, 3.3 parts of alcohol, and 1.0 parts of gasoline.

The uniformly mixed two-phase composition is passed to a settling (or separation) operation wherein at 25° F.–125° F., say 75° F., the two phases separate. The upper hydrocarbon layer is recovered from the settling (or separation) operation as a haze-free substantially dry composition which may be withdrawn.

The lower aqueous layer is withdrawn and passed to a reaction operation to which there is added as reactant a ketal, an acetal, or an orthoester. Mixtures of these components may be employed.

The ketal may be characterized by the formula $R_2C(OR')_2$; the acetal may be characterized by the formula $RCH(OR')_2$; and the orthoester may be characterized by the formula $RC(OR')_3$.

In the above compound, R or R′ may be a hydrocarbon radical selected from the group consisting of alkyl and cycloalkyl, including such radicals when inertly substituted. When R is alkyl, it may typically be methyl, ethyl, n-propyl, iso-propyl, n-butyl, 1-butyl sec-buty, amyl, octyl, decyl, octadecyl, etc. When R is cycloalkyl, it may typically be cyclohexyl, cycloheptyl, cyclooctyl, 2-methylcycloheptyl, 3-butylcyclohexyl 3-methylcyclohexyl, etc. R may be inertly substituted i.e. it may bear a non-reactive substituent such as alkyl, cycloalkyl, ether, halogen, etc. Typically inertly substituted R groups may include 3-chloropropyl, 2-ethoxyethyl, carboethoxymethyl, 4-methyl cyclohexyl, etc. The preferred R groups may be lower alkyl, i.e. $C_1$–$C_{10}$ alkyl, groups including eg methyl, ethyl, n-propyl, i-propyl, butyls, amyls, hexyls octyls, decyls, etc. R may preferably be methyl. R′ may preferably be methyl or ethyl.

In the preferred embodiment, R and R′ may be lower alkyl i.e. $C_1$ to $C_{10}$ but more preferably $C_1$ to $C_4$ alkyl. Illustrative ketals may include:

TABLE 2,2-dimethoxy propane
2,2-dimethoxy pentane
2,2-dimethoxy butane
3,3-dimethoxy pentane
2,2-diethoxy propane
2,2-di(cyclohexoxy) propane, etc.

Illustrative acetals may include:

TABLE di-methoxy methane
1,1-di-methoxy propane
1,1-diethoxy propane
1,1-dipropoxy propane
1,1-dimethoxy-n-butane
1,1-diethoxy-n-butane Illustrative orthoesters may include:

TABLE methyl orthoformate
ethyl orthoformate
methyl orthobutyrate
n-propyl orthoacetate Although the reaction operation may be a mixing vessel, it is preferred that it be a packed bed through which the lower aqueous phase and the added reactant passes as reaction is effected in the presence of acid catalyst.

The acid catalyst which may be employed in small-to-trace amounts may be an inorganic acid such as sulfuric acid, hydrochloric acid, etc. or an organic acid such as the strong acid p-toluene sulfonic acid etc. Typically such acids may be employed in amount of 0.0001 v %–1 v %, preferably 0.001 v %–0.1 v %, say 0.05 v % of the total composition. Concentrated sulfuric acid, in amount of 10 ppm, has been found to be satisfactory. Reaction may be run in a packed bed at 1–20 WHSV at 25° F.–200° F. or higher at 50–200 psig.

It is a particular feature of the process of this invention that it may be possible to use solid acid composition bearing protons to catalyse the reaction of water with ketal or acetal or orthoester. Typical of such solid acids are resins such as reticular sulfonated styrene-divinyl benzene copolymer cation exchange resins typified by the Rohm and Haas Amberlyst 15 having a hydrogen ion concentration of 4.9 meq per gram of dry resin and a surface area of 42.5 square meters per gram.

The acid catalyst is commonly employed in catalytic amount sufficient to produce in the aqueous phase a pH low enough to catalyze the reaction of acetal or ketal or orthoester with water. Typically a pH below 7 and commonly 1–6.5. Preferred range may be above about 5 and below 7 in the aqueous phase.

In the preferred embodiment, the pelletted solid resin acid catalyst may be used in the form of a gravity packed bed through which the reactant and the aqueous layer pass.

The ketal or acetal or orthoester may function by reacting with the water in the presence of catalytic amounts of acid thereby forming alcohols. Thus the additives remove the water and also form alcohols which are miscible with the composition. When the reactant contains methyl or ethyl groups, the resultant alcohols formed are methanol and ethanol.

In the case of the preferred ketal reactant 2,2-dimethoxy propane, the reaction may be

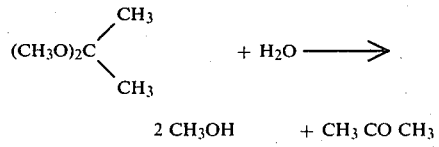

In the case of acetal, the reaction may be $$(CH_3O)_2CHCH_3 + H_2O \rightarrow 2CH_3OH + CH_3CHO$$

In the case of orthoester, the reaction may be $$(C_2H_5O)_3CH + H_2O \rightarrow 2C_2H_5OH + C_2H_5OCHO$$

The amount of reactant present will preferably be 1 w %–10 w % greater than the equivalent amount of water in the aqueous layer of water. In the case of the acetal and ketal, the equivalent amount of reactant is 1.0 moles of reactant per mole of water; and in the case of the orthoester, the equivalent amount thereof is also 1.0 moles per mole of water.

Reaction is typically effected at 25° F.–200° F., say 100° F. and the reaction effluent typically contains (i) alcohol, (ii) ketone or aldehyde, (iii) water in amount less then about 2 w %, and (iv) reactant. The reaction effluent is a single phase substantially water-free composition.

Reaction effluent, typically 1–10 parts, say 5 parts is preferably blended with 90–99 parts, say 95 parts of the upper hydrocarbon-rich phase recovered from the separation operation to form a single phase substantially water-free product. In the case of gasahol, the net product may be a single phase substantially water-free gasahol product.

Practice of the process of this invention will be apparent to those skilled in the art from the Examples which follow wherein as elsewhere this description, all parts are parts by weight unless otherwise stated.

DESCRIPTION OF PREFERRED EMBODIMENTS

In the drawing, which is a schematic flowsheet of the best mode contemplated of practicing the process of this invention, 3406 parts of gasoline (containing less than 0.01 w % water) are admitted through line 10 together with 385 parts of 95 w % ethanol through line 11 to blender 12. Although it may be possible to utilize a mixing tank (with or without agitation) operation 12 may preferably include a packed bed. There is removed through line 13 a two phase gasahol composition (3491 parts) which is passed at ambient temperature of 75° F. to separation operation 14.

From separation operation 14 there is withdrawn through line 15 a single phase haze-free gasahol (3733 parts) which contains 3370 parts of gasoline, 351 parts of alcohol, and 11 parts of water.

The heavy bottoms layer in separation operation 14 (58 parts) withdrawn through line 16 contains 38 parts of alcohol 8 parts of water, and 12 parts gasoline. This stream is passed through line 16 to reaction operation 17 to which there is added in this embodiment 53 parts of 2,2-dimethoxy propane through line 18. Reaction occurs in reaction operation 17 as the mixture is passed through a bed of Amberlyst 15, a pelletted solid ion-exchange resin containing acid-form sulfonated polystyrene cross-linked with divinyl benzene.

Reaction is effected at pH below 7 between the water and the ketal 2,2-dimethoxy propane to produce methanol and acetone; and since the amount of the ketal charged is greater than the equivalent amount of water in the charge, the net product contains a small quantity of unreacted ketal. Product leaving reaction operation 17 through line 19 (111 parts) contains 38 parts of ethyl alcohol, 28 parts of methyl alcohol, 30 parts of acetone, less than 1 part of water, 2 parts of unreacted ketal, and 12 parts of gasoline.

This stream in line 19 is blended with the stream in line 15 in blending operation 20 which may be a tank (with or without agitation) but more preferably is a bed of inert packing. Product recovered through line 21 in amount of 3841 parts is a single phase haze-free product containing 3387 parts of gasoline, 382 parts of ethanol, 28 parts of methanol, 30 parts of acetone, 2 parts of 2,2-dimethoxy propane, and less than 1 part of water.

It will be apparent to those skilled in the art that the process of this invention permits attainment of many advantages including the following:

(i) it permits attainment of a substantially water-free hydrocarbon product, such as gasahol, prepared from a wet charge;

(ii) the separation of the water phase for separate handling permits greater ease of operation because this phase is usually less than 10 v % of the total of the two phases;

(iii) the reaction of the water phase and the reactant (in the absence of hydrocarbon phase) permits the reaction to take place more quickly smaller quantities of the reactant than would be required if the hydrocarbon were present during the reaction.

Although this invention has been illustrated by reference to specific embodiments, it will be apparent to those skilled in the art that various changes and modifications may be made which clearly fall within the scope of this invention.

We claim:

1. The method which comprises (i) mixing a liquid hydrocarbon fuel and aqueous alcohol thereby forming a two-phase wet hydrocarbon fuel including (i) an upper hydrocarbon-rich phase and (ii) a lower phase containing alcohol and water;

(ii) separating said lower phase containing alcohol and water from said upper hydrocarbon-rich phase;

(iii) reacting said lower phase containing alcohol and water at pH below 7 with a ketal, an acetal, or an orthoester whereby said ketal, acetal, or orthoester reacts with said water thereby forming a substantially water-free composition;

(iv) blending said water-free composition and said upper hydrocarbon-rich phase thereby forming a single phase dry hydrocarbon product; and (v) recovering said single phase dry hydrocarbon product.

2. The method claimed in claim 1 wherein said liquid hydrocarbon fuel is a gasoline.

3. The method claimed in claim 1 wherein said liquid hydrocarbon fuel is a fuel oil.

4. The method claimed in claim 1 wherein said liquid hydrocarbon fuel is a furnace oil.

5. The method claimed in claim 1 wherein said alcohol is methanol.

6. The method claimed in claim 1 wherein said alcohol is ethanol.

7. The method claimed in claim 1 wherein said alcohol is 95 w % ethanol.

8. The method claimed in claim 1 wherein said ketal is 2,2-dimethoxy propane.

9. The method claimed in claim 1 wherein said orthoester is ethyl orthoformate.

10. The method which comprises (i) mixing gasoline and wet ethanol thereby forming a two-phase wet hydrocarbon fuel including (i) an upper gasoline-rich phase and (ii) a lower phase containing ethanol and water;

(ii) separating said lower phase containing ethanol and water from said upper gasoline-rich phase;

(iii) reacting said lower phase containing ethanol and water at pH below 7 with a ketal, an acetal, or an orthoester whereby said ketal, acetal, or orthoester reacts with said water thereby forming a substantially water-free composition;

(iv) blending said water-free composition and said upper gasoline-rich phase thereby forming a single phase dry gasoline product; and (v) recovering said single phase dry gasoline product.

11. The method claimed in claim 10 wherein said wet ethanol is 95 w % ethanol.

12. The method claimed in claim 10 wherein said ketal is 2,2-dimethoxy propane.

* * * * *